US012221663B2

(12) United States Patent
Endo et al.

(10) Patent No.: US 12,221,663 B2
(45) Date of Patent: Feb. 11, 2025

(54) MARTENSITIC STAINLESS STEEL SEAMLESS PIPE FOR OIL COUNTRY TUBULAR GOODS, AND METHOD FOR MANUFACTURING SAME

(71) Applicant: JFE STEEL CORPORATION, Tokyo (JP)

(72) Inventors: Mami Endo, Tokyo (JP); Yuichi Kamo, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 976 days.

(21) Appl. No.: 17/058,781

(22) PCT Filed: Apr. 25, 2019

(86) PCT No.: PCT/JP2019/017539
§ 371 (c)(1),
(2) Date: Nov. 25, 2020

(87) PCT Pub. No.: WO2019/225281
PCT Pub. Date: Nov. 28, 2019

(65) Prior Publication Data

US 2021/0198764 A1 Jul. 1, 2021

(30) Foreign Application Priority Data

May 25, 2018 (JP) ..... 2018-100107

(51) Int. Cl.

| | |
|---|---|
| ***C21D 9/08*** | (2006.01) |
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 9/08* (2013.01); *C21D 1/18* (2013.01); *C21D 6/004* (2013.01); *C21D 6/005* (2013.01); *C21D 6/007* (2013.01); *C21D 6/008* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2005/0224143 | A1 | 10/2005 | Takabe et al. | |
| 2007/0006946 | A1 | 1/2007 | Takano | |
| 2007/0251611 | A1 | 11/2007 | Inage | |
| 2012/0328897 | A1 | 12/2012 | Ohe et al. | |
| 2019/0136337 | A1* | 5/2019 | Eguchi | C22C 38/22 |
| 2022/0074009 | A1* | 3/2022 | Endo | C21D 1/25 |

FOREIGN PATENT DOCUMENTS

| | | | |
|---|---|---|---|
| CN | 1154145 | A | 7/1997 |
| CN | 1302340 | A | 7/2001 |
| CN | 1816639 | A | 8/2006 |
| CN | 1891398 | A | 1/2007 |
| CN | 101041882 | A | 9/2007 |
| CN | 101171351 | A | 4/2008 |
| CN | 101437973 | A | 5/2009 |
| CN | 105734453 | A | 7/2016 |

(Continued)

OTHER PUBLICATIONS

Sep. 20, 2022 Office Action issued in Chinese Patent Application No. 201980034873.5.
Jul. 30, 2019 International Search Report issued in International Application No. PCT/JP2019/017539.
Jan. 26, 2022 Office Action issued in Chinese Patent Application No. 201980034873.5.
Wang, Zhengqiao et al., "Encyclopedia of Corrosion and Protection: Stainless Steel," Chemical Industry Press, 1st edition, Dec. 1991.
Jun. 27, 2022 Office Action issued in Chinese Patent Application No. 201980034873.5.

(Continued)

*Primary Examiner* — Xiaowei Su
(74) *Attorney, Agent, or Firm* — Oliff PLC

(57) ABSTRACT

The invention is intended to provide a martensitic stainless steel seamless pipe for oil country tubular goods having a yield stress of 758 MPa or more, and excellent sulfide stress corrosion cracking resistance. A method for manufacturing such a martensitic stainless steel seamless pipe is also provided. The martensitic stainless steel seamless pipe for oil country tubular goods has a composition that contains, in mass %, C: 0.010% or more, Si: 0.5% or less, Mn: 0.05 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.010 to 0.054%, Cu: 0.01 to 1.0%, and Co: 0.01 to 1.0%. C, Mn, Cr, Cu, Ni, Mo, W, N, and Ti satisfy the predetermined relations, and the balance is Fe and incidental impurities. The martensitic stainless steel seamless pipe has a yield stress of 758 MPa or more.

10 Claims, No Drawings

(56) References Cited

FOREIGN PATENT DOCUMENTS

| | | | |
|---|---|---|---|
| EP | 1 099 772 | A1 | 5/2001 |
| EP | 1 652 950 | A1 | 5/2006 |
| EP | 2 172 573 | A1 | 4/2010 |
| EP | 3 460 087 | A1 | 3/2019 |
| JP | 2000-160300 | A | 6/2000 |
| JP | 2001-026820 | A | 1/2001 |
| JP | 2001-32047 | A | 2/2001 |
| JP | 2004-091812 | A | 3/2004 |
| JP | 2007-332442 | A | 12/2007 |
| JP | 2010-242163 | A | 10/2010 |
| WO | 2004/057050 | A1 | 7/2004 |
| WO | 2008/023702 | A1 | 2/2008 |
| WO | 2017/168874 | A1 | 10/2017 |
| WO | 2017200083 | A1 | 11/2017 |
| WO | 2018/079111 | A1 | 5/2018 |
| WO | 2019/065115 | A1 | 4/2019 |

OTHER PUBLICATIONS

Jan. 28, 2021 Extended European Search Report issued in European Patent Application No. 19808238.0.
Jun. 3, 2021 Office Action issued in Chinese Patent Application No. 201980034873.5.

* cited by examiner

MARTENSITIC STAINLESS STEEL SEAMLESS PIPE FOR OIL COUNTRY TUBULAR GOODS, AND METHOD FOR MANUFACTURING SAME

TECHNICAL FIELD

This application relates to a martensitic stainless steel seamless pipe for use in crude oil well and natural gas well applications (hereinafter, referred to simply as "oil country tubular goods"), and to a method for manufacturing such a martensitic stainless steel seamless pipe. The application relates to a martensitic stainless steel seamless pipe for oil country tubular goods having a yield stress YS of 758 MPa or more, and excellent sulfide stress corrosion cracking resistance (SSC resistance) in a hydrogen sulfide ($H_2S$)-containing environment, and to a method for manufacturing such a martensitic stainless steel seamless pipe for oil country tubular goods.

BACKGROUND

Increasing crude oil prices and an expected shortage of petroleum resources in the near future have prompted active development of oil country tubular goods for use in applications that were unthinkable in the past, for example, such as in deep oil fields, and in oil fields and gas oil fields of severe corrosive environments containing carbon dioxide gas, chlorine ions, and hydrogen sulfide. The material of steel pipes for oil country tubular goods intended for these environments requires high strength, and excellent corrosion resistance.

Oil country tubular goods used for mining of oil fields and gas fields of an environment containing carbon dioxide gas, chlorine ions, and the like typically use 13% Cr martensitic stainless steel pipes. There has also been global development of oil fields in very severe corrosive environments containing hydrogen sulfide. Accordingly, the need for SSC resistance is high, and there has been increasing use of an improved 13% Cr martensitic stainless steel pipe of a reduced C content and increased Ni and Mo contents.

PTL 1 describes a composition using a 13% Cr-base steel as a basic composition, in which C is contained in a much smaller content than in common stainless steels, and Ni, Mo, and Cu are contained so as to satisfy $Cr+2Ni+1.1Mo+0.7Cu \leq 32.5$. The composition also contains at least one of Nb: 0.20% or less, and V: 0.20% or less so as to satisfy the condition $Nb+V \geq 0.05\%$. It is stated in PTL 1 that this will provide high strength with a yield stress of 965 MPa or more, high toughness with a Charpy absorption energy at −40° C. of 50 J or more, and desirable corrosion resistance.

PTL 2 describes a 13% Cr-base martensitic stainless steel pipe of a composition containing carbon in an ultra low content of 0.015% or less, and 0.03% or more of Ti. It is stated in PTL 2 that this stainless steel pipe has high strength with a yield stress on the order of 95 ksi, low hardness with an HRC of less than 27, and excellent SSC resistance. PTL 3 describes a martensitic stainless steel that satisfies $6.0 \; Ti/C \leq 10.1$, where Ti/C has a correlation with a value obtained by subtracting a yield stress from a tensile stress. It is stated in PTL 3 that this technique, with a value obtained by subtracting a yield stress from a tensile stress being 20.7 MPa or more, can reduce hardness variation that impairs SSC resistance.

PTL 4 describes a martensitic stainless steel containing Mo in a limited content of $Mo \geq 2.3-0.89Si+32.2C$, and having a metal microstructure composed mainly of tempered martensite, carbides that have precipitated during tempering, and intermetallic compounds such as a Laves phase and a δ phase formed as fine precipitates during tempering. It is stated in PTL 4 that the steel produced by this technique achieves high strength with a 0.2% proof stress of 860 MPa or more, and has excellent carbon dioxide corrosion resistance and sulfide stress corrosion cracking resistance.

CITATION LIST

Patent Literature

PTL 1: JP-A-2007-332442
PTL 2: JP-A-2010-242163
PTL 3: WO2008/023702
PTL 4: WO2004/057050

SUMMARY

Technical Problem

The development of recent oil fields and gas fields is made in severe corrosive environments containing $CO_2$, $Cl^-$, and $H_2S$. Increasing $H_2S$ concentrations due to aging are also of concern. Steel pipes for oil country tubular goods for use in these environments are therefore required to have excellent sulfide stress corrosion cracking resistance (SSC resistance), in addition to carbon dioxide corrosion resistance. However, the technique described in PTL 1, which describes a steel having excellent corrosion resistance against $CO_2$, does not take into account sulfide stress corrosion cracking resistance, and it cannot be said that the steel has corrosion resistance against a severe corrosive environment.

PTL 2 states that sulfide stress corrosion cracking resistance can be maintained under an applied stress of 655 MPa in an atmosphere of a 5% NaCl aqueous solution ($H_2S$: 0.10 bar) having an adjusted pH of 3.5. The steel described in PTL 3 has sulfide stress corrosion cracking resistance in an atmosphere of a 20% NaCl aqueous solution ($H_2S$: 0.03 bar, $CO_2$ bal.) having an adjusted pH of 4.5. The steel described in PTL 4 has sulfide stress corrosion cracking resistance in an atmosphere of a 25% NaCl aqueous solution ($H_2S$: 0.03 bar, $CO_2$ bal.) having an adjusted pH of 4.0. However, these patent applications do not take into account sulfide stress corrosion cracking resistance in atmospheres other than those described above and it cannot be said that the steels described in these patent applications have the level of sulfide stress corrosion cracking resistance that can withstand the today's ever demanding severe corrosive environments.

It is accordingly an object of the disclosed embodiments to provide a martensitic stainless steel seamless pipe for oil country tubular goods having a yield stress of 758 MPa or more, and excellent sulfide stress corrosion cracking resistance. The disclosed embodiments are also intended to provide a method for manufacturing such a martensitic stainless steel seamless pipe.

As used herein, "excellent sulfide stress corrosion cracking resistance" means that a test piece dipped in a test solution (a 20 weight % NaCl aqueous solution; liquid temperature: 25° C.; $H_2S$: 0.1 bar; $CO_2$ bal.) having an adjusted pH of 4.0 with addition of sodium acetate and acetic acid does not crack even after 720 hours under an applied stress equal to 90% of the yield stress.

Solution to Problem

In order to achieve the foregoing objects, the inventors conducted intensive studies of the effects of various alloy elements on sulfide stress corrosion cracking resistance (SSC resistance) in a $CO_2$—, $Cl^-$-, and $H_2S$-containing corrosive environment, using a 13% Cr-base stainless steel pipe as a basic composition. The studies found that a martensitic stainless steel seamless pipe for oil country tubular goods having the desired strength, and excellent SSC resistance in a $CO_2$—, $Cl^-$-, and $H_2S$-containing corrosive environment, and in an environment under an applied stress close to the yield stress can be provided when the steel contains C, Mn, Cr, Cu, Ni, Mo, N, and Ti, and, optionally, Nb and W, in adjusted amounts that satisfy the appropriate relations, and when the steel is subjected to appropriate quenching and tempering.

The disclosed embodiments are based on this finding, and was completed after further studies. Specifically, the gist of the disclosed embodiments is as follows.

[1] A martensitic stainless steel seamless pipe for oil country tubular goods having a composition comprising, in mass %, C: 0.010% or more, Si: 0.5% or less, Mn: 0.05 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.010 to 0.054%, Cu: 0.01 to 1.0%, and Co: 0.01 to 1.0%, in which the following formulae (1) and (2) satisfy the formula (3) below, and the balance is Fe and incidental impurities, the martensitic stainless steel seamless pipe having a yield stress of 758 MPa or more.

$$-0.0278Mn+0.0892Cr+0.00567Ni+0.153Mo-0.0219W-1.984N+0.208Ti-1.83 \quad \text{Formula (1)}$$

$$-1.324C+0.0533Mn+0.0268Cr+0.0893Cu+0.00526Ni+0.0222Mo-0.0132W-0.473N-0.5Ti-0.514 \quad \text{Formula (2)}$$

In the formulae, C, Mn, Cr, Cu, Ni, Mo, W, N, and Ti represent the content of each element in mass %, and the content is 0 (zero) percent for elements that are not contained.

$$-0.600 \leq \text{formula (1)} \leq -0.250, \text{ and}$$

$$-0.400 \leq \text{formula (2)} \leq 0.100 \quad \text{Formula (3)}$$

[2] The martensitic stainless steel seamless pipe for oil country tubular goods according to item [1], wherein the composition further comprises, in mass %, at least one selected from Nb: 0.1% or less, and W: 1.0% or less.

[3] The martensitic stainless steel seamless pipe for oil country tubular goods according to item [1] or [2], wherein the composition further comprises, in mass %, one or more selected from Ca: 0.010% or less, REM: 0.010% or less, Mg: 0.010% or less, and B: 0.010% or less.

[4] A method for manufacturing a martensitic stainless steel seamless pipe for oil country tubular goods, the method comprising:

forming a steel pipe from a steel pipe material of the composition of any one of items [1] to [3];

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

Advantageous Effects

The disclosed embodiments have enabled production of a martensitic stainless steel seamless pipe for oil country tubular goods having excellent sulfide stress corrosion cracking resistance (SSC resistance) in a $CO_2$-, $Cl^-$-, and $H_2S$-containing corrosive environment, and high strength with a yield stress YS of 758 MPa or more.

DETAILED DESCRIPTION

The following describes the reasons for specifying the composition of a steel pipe of the disclosed embodiments. In the following, "%" means percent by mass, unless otherwise specifically stated.

C: 0.010% or More

C has the effect to provide an effective amount of Cr, and ensure corrosion resistance. To this end, the C content is limited to 0.010% or more. However, when C is contained in excess amounts, the hardness increases, and the steel becomes more susceptible to sulfide stress corrosion cracking. For this reason, C is contained in an amount of desirably 0.040% or less. That is, the preferred carbon content is 0.010 to 0.040%.

Si: 0.5% or Less

Si acts as a deoxidizing agent, and is contained in an amount of desirably 0.05% or more. A Si content of more than 0.5% impairs carbon dioxide corrosion resistance and hot workability. For this reason, the Si content is limited to 0.5% or less. From the viewpoint of stably providing strength, the Si content is preferably 0.10% or more, and is preferably 0.30% or less.

Mn: 0.05 to 0.50%

Mn is an element that improves hot workability and strength, and is contained in an amount of 0.05% or more to provide the necessary strength. When added in excess amounts, however, Mn precipitates into MnS, and impairs the sulfide stress corrosion cracking resistance. For this reason, the Mn content is limited to 0.05 to 0.50%. Preferably, the Mn content is 0.40% or less. Preferably, the Mn content is 0.10% or more.

P: 0.030% or Less

P is an element that impairs carbon dioxide corrosion resistance, pitting corrosion resistance, and sulfide stress corrosion cracking resistance, and should desirably be contained in as small an amount as possible in the disclosed embodiments. However, an excessively small P content increases the manufacturing cost. For this reason, the P content is limited to 0.030% or less, which is a content range that does not cause a severe impairment of characteristics, and that is economically practical in industrial applications. Preferably, the P content is 0.015% or less.

S: 0.005% or Less

S is an element that seriously impairs hot workability, and should desirably be contained in as small an amount as possible. A reduced S content of 0.005% or less enables pipe production using an ordinary process, and the S content is limited to 0.005% or less in the disclosed embodiments. Preferably, the S content is 0.002% or less.

Ni: 4.6 to 8.0%

Ni strengthens the protective coating, and improves the corrosion resistance. Ni also increases steel strength by forming a solid solution. Ni needs to be contained in an amount of 4.6% or more to obtain these effects. With a Ni content of more than 8.0%, the martensitic phase becomes less stable, and the strength decreases. For this reason, the Ni content is limited to 4.6 to 8.0%. The Ni content is preferably 5.0% or more, and is preferably 7.5% or less.

Cr: 10.0 to 14.0%

Cr is an element that forms a protective coating, and improves the corrosion resistance. The required corrosion resistance for oil country tubular goods can be provided when Cr is contained in an amount of 10.0% or more. A Cr content of more than 14.0% facilitates ferrite generation, and a stable martensitic phase cannot be provided. For this reason, the Cr content is limited to 10.0 to 14.0%. The Cr content is preferably 11.0% or more, and is preferably 13.5% or less.

Mo: 1.0 to 2.7%

Mo is an element that improves the resistance against pitting corrosion by $Cl^-$. Mo needs to be contained in an amount of 1.0% or more to obtain the corrosion resistance necessary for a severe corrosive environment. When Mo is contained in excess amounts, the effect becomes saturated. Mo is also an expensive element, and a Mo content of more than 2.7% increases the manufacturing cost. For this reason, the Mo content is limited to 1.0 to 2.7%. The Mo content is preferably 1.5% or more, and is preferably 2.5% or less.

Al: 0.1% or Less

Al acts as a deoxidizing agent, and an Al content of 0.01% or more is effective for obtaining this effect. However, Al has an adverse effect on toughness when contained in an amount of more than 0.1%. For this reason, the Al content is limited to 0.1% or less in the disclosed embodiments. The Al content is preferably 0.01% or more, and is preferably 0.03% or less.

V: 0.005 to 0.2%

V needs to be contained in an amount of 0.005% or more to improve steel strength through precipitation hardening, and to improve sulfide stress corrosion cracking resistance. Because a V content of more than 0.2% impairs toughness, the V content is limited to 0.005 to 0.2% in the disclosed embodiments. The V content is preferably 0.01% or more, and is preferably 0.1% or less.

N: 0.1% or Less

N is an element that acts to increase strength by forming a solid solution in the steel, in addition to improving pitting corrosion resistance. However, N forms various nitride inclusions, and impairs pitting corrosion resistance when contained in an amount of more than 0.1%. For this reason, the N content is limited to 0.1% or less in the disclosed embodiments. Preferably, the N content is 0.010% or less.

Ti: 0.010 to 0.054%

Ti fixes C, and acts to reduce strength variation. Ti needs to be contained in an amount of 0.010% or more to obtain this effect. However, when contained in an amount of more than 0.054%, Ti generates TiN, which, with its size equal to or greater than 5 μm, potentially becomes an initiation point of pitting corrosion, and impairs the sulfide stress corrosion cracking resistance. For this reason, the Ti content is limited to 0.010 to 0.054%. The Ti content is preferably 0.015% or more, and is preferably 0.050% or less.

Cu: 0.01 to 1.0%

Cu is contained in an amount of 0.01% or more to strengthen the protective coating, and improve sulfide stress corrosion cracking resistance. However, when contained in an amount of more than 1.0%, Cu precipitates into CuS, and impairs hot workability. For this reason, the Cu content is limited to 0.01 to 1.0%. The Cu content is preferably 0.03% or more, and is preferably 0.6% or less.

Co: 0.01 to 1.0%

Co is an element that improves the pitting corrosion resistance, in addition to reducing hardness by raising the Ms point and promoting a transformation. Co needs to be contained in an amount of 0.01% or more to obtain these effects. However, an excessively high Co content may impair toughness, and increases the material cost. Such high Co contents also impair the sulfide stress corrosion cracking resistance. For this reason, the Co content is limited to 0.01 to 1.0% in the disclosed embodiments. The Co content is more preferably 0.03% or more, and is preferably 0.6% or less.

In the disclosed embodiments, C, Mn, Cr, Cu, Ni, Mo, N, and Ti, and, optionally, W, are contained in such amounts that the following formulae (1) and (2) satisfy the formula (3) below. Formula (1) correlates with repassivation potential. Formula (2) correlates with pitting corrosion potential. A passive film regenerates more easily when C, Mn, Cr, Cu, Ni, Mo, W, N, and Ti are contained in such amounts that formula (1) satisfies the range of formula (3), and that formula (2) satisfies the range of formula (3). By satisfying these conditions, it is also possible to reduce generation of pitting corrosion, which becomes an initiation point of sulfide stress corrosion cracking, and to greatly improve sulfide stress corrosion cracking resistance.

$$-0.0278Mn+0.0892Cr+0.00567Ni+0.153Mo-0.0219W-1.984N+0.208Ti-1.83 \quad \text{Formula (1)}$$

$$-1.324C+0.0533Mn+0.0268Cr+0.0893Cu+0.00526Ni+0.0222Mo-0.0132W-0.473N-0.5Ti-0.514 \quad \text{Formula (2)}$$

In the formulae, C, Mn, Cr, Cu, Ni, Mo, W, N, and Ti represent the content of each element in mass %, and the content is 0 (zero) percent for elements that are not contained.

$$-0.600 \leq \text{formula (1)} \leq -0.250, \text{ and}$$

$$-0.400 \leq \text{formula (2)} \leq 0.100 \quad \text{Formula (3)}$$

These are the basic components. In addition to these basic components, the composition may further contain at least one optional element selected from Nb: 0.1% or less, and W: 1.0% or less, as needed.

Nb forms carbides, and can reduce hardness by reducing solid-solution carbon. However, Nb may impair toughness when contained in excessively large amounts. W is an element that improves the pitting corrosion resistance. However, W may impair toughness, and increases the material cost when contained in excessively large amounts. For this reason, Nb, when contained, is contained in a limited amount of 0.1% or less, and W, when contained, is contained in a limited amount of 1.0% or less. Preferably, the Nb content is 0.02% or more, and the W content is 0.1% or more.

One or more selected from Ca: 0.010% or less, REM: 0.010% or less, Mg: 0.010% or less, and B: 0.010% or less may be contained as optional elements, as needed.

Ca, REM, Mg, and B are elements that improve the corrosion resistance by controlling the form of inclusions. The desired contents for providing this effect are Ca: 0.0005% or more, REM: 0.0005% or more, Mg: 0.0005% or more, and B: 0.0005% or more. Ca, REM, Mg, and B impair toughness and carbon dioxide corrosion resistance when contained in amounts of more than Ca: 0.010%, REM: 0.010%, Mg: 0.010%, and B: 0.010%. For this reason, the contents of Ca, REM, Mg, and B, when contained, are limited to Ca: 0.010% or less, REM: 0.010% or less, Mg: 0.010% or less, and B: 0.010% or less.

The balance is Fe and incidental impurities in the composition.

A steel pipe of the disclosed embodiments has a microstructure in which the dominant phase is the tempered martensitic phase, and that contains 30% or less of retained austenite phase, and 5% or less of ferrite phase, by volume. As used herein, "dominant phase" is the phase that accounts for 70% or more by volume.

The following describes a preferred method for manufacturing a stainless steel seamless pipe for oil country tubular goods of the disclosed embodiments.

In the disclosed embodiments, a steel pipe material of the foregoing composition is used. However, the method of production of a stainless steel seamless pipe used as a steel pipe material is not particularly limited, and any known seamless pipe manufacturing method may be used.

Preferably, a molten steel of the foregoing composition is made into steel using an ordinary steel making process such as by using a converter, and formed into a steel pipe material, for example, a billet, using a method such as continuous casting, or ingot casting-blooming. The steel pipe material is then heated, and hot worked into a pipe using a known pipe manufacturing process, for example, the Mannesmann-plug mill process or the Mannesmann-mandrel mill process to produce a seamless steel pipe of the foregoing composition.

The process after the production of the steel pipe from the steel pipe material is not particularly limited. Preferably, the steel pipe is subjected to quenching in which the steel pipe is heated to a temperature equal to or greater than the $Ac_3$ transformation point, and cooled to a cooling stop temperature of 100° C. or less, followed by tempering at a temperature equal to or less than the $Ac_1$ transformation point.

Quenching

In the disclosed embodiments, the steel pipe is subjected to quenching in which the steel pipe is reheated to a temperature equal to or greater than the $Ac_3$ transformation point, held for preferably at least 5 min, and cooled to a cooling stop temperature of 100° C. or less. This makes it possible to produce a refined, tough martensitic phase. When the heating temperature of quenching is less than the $Ac_3$ transformation point, it is not possible to heat the steel in the austenite single-phase region, and a sufficient martensitic microstructure does not occur in the subsequent cooling, with the result that the desired high strength cannot be obtained. For this reason, the quenching heating temperature is limited to a temperature equal to or greater than the $Ac_3$ transformation point. The cooling method is not particularly limited. Typically, the steel pipe is air cooled (at a cooling rate of 0.05° C./s or more and 20° C./s or less) or water cooled (at a cooling rate of 5° C./s or more and 100° C./s or less). The cooling rate conditions are not limited either.

Tempering

The quenched steel pipe is tempered. The tempering is a process in which the steel pipe is heated to a temperature equal to or less than the $Ac_1$ transformation point, held for preferably at least 10 min, and air cooled. The austenite phase occurs when the tempering temperature is higher than the $Ac_1$ transformation point. In this case, it is not possible to provide the desired high strength, high toughness, and desirable corrosion resistance. For this reason, the tempering temperature is limited to a temperature equal to or less than the $Ac_1$ transformation point. Preferably, the tempering temperature is 565 to 600° C. The $Ac_3$ transformation point (° C.) and $Ac_1$ transformation point (° C.) can be measured by a Formaster test by giving a heating and cooling temperature history to a test piece, and finding the transformation point from a microdisplacement due to expansion and contraction.

EXAMPLES

The disclosed embodiments are further described below through the Examples.

Molten steels containing the components shown in Table 1 were made into steel with a converter, and cast into billets (steel pipe material) by continuous casting. The billet was hot worked into a pipe with a model seamless rolling mill, and cooled by air cooling or water cooling to produce a seamless steel pipe measuring 83.8 mm in outer diameter and 12.7 mm in wall thickness.

Each seamless steel pipe was cut to obtain a test material, which was then subjected to quenching and tempering under the conditions shown in Table 2. A test piece for microstructure observation was taken from the quenched and tempered test material. After polishing, the amount of retained austenite (γ) was measured by X-ray diffractometry.

Specifically, the amount of retained austenite was found by measuring the diffraction X-ray integral intensities of the γ (220) plane, and the (211) plane of the ferrite (α). The results were then converted using the following equation.

$$\gamma(\text{volume fraction})=100/(1+(1_{\alpha}R_{\gamma}/I_{\gamma}R_{\alpha}))$$

In the equation, $I_\alpha$ represents the integral intensity of α, $R_\alpha$ represents a crystallographic theoretical calculation value for α, $I_\gamma$ represents the integral intensity of γ, and $R_\gamma$ represents a crystallographic theoretical calculation value for γ. For the measurement, Mo-Kα radiation was used under the acceleration voltage of 50 kV.

An arc-shaped tensile test specimen specified by API standard was taken from the quenched and tempered test material, and the tensile properties (yield stress YS, tensile strength TS) were determined in a tensile test conducted according to the API-5CT specification. For the measurement of the $Ac_3$ and $Ac_1$ points (° C.) in Table 2, a test piece (4-mm diameter×10 mm) was taken from the quenched test material, and was measured in a Formaster test. Specifically, the test piece was heated to 500° C. at 5° C./s, and further heated to 920° C. at 0.25° C./s. The steel was then held for 10 minutes, and cooled to room temperature at 2° C./s. The $Ac_3$ and $Ac_1$ transformation points (° C.) were determined by detecting the expansion and contraction occurring in the test piece with this temperature history.

The SSC test was conducted according to NACE TM0177, Method A. The test environment was created by adjusting the pH of a test solution (a 20 weight % NaCl aqueous solution; liquid temperature: 25° C.; $H_2S$: 0.1 bar; $CO_2$ bal.) to 4.0 with addition of 0.82 g/L of sodium acetate and acetic acid. In the test, a stress 90% of the yield stress was applied for 720 hours in the solution. Samples were determined as being acceptable when there was no crack in the test piece after the test, and unacceptable when the test piece had a crack after the test.

The results are presented in Table 2.

TABLE 1

| Steel | Composition (mass %) | | | | | | | | | |
|---|---|---|---|---|---|---|---|---|---|---|
| No. | C | Si | Mn | P | S | Ni | Cr | Mo | Al | V |
| A | 0.0104 | 0.20 | 0.42 | 0.015 | 0.001 | 5.81 | 12.1 | 2.02 | 0.037 | 0.015 |
| B | 0.0114 | 0.19 | 0.21 | 0.017 | 0.001 | 5.56 | 11.8 | 1.87 | 0.042 | 0.044 |
| C | 0.0108 | 0.20 | 0.34 | 0.015 | 0.001 | 5.81 | 12.0 | 2.04 | 0.039 | 0.039 |

TABLE 1-continued

| | | | | | | | | | | |
|---|---|---|---|---|---|---|---|---|---|---|
| D | 0.0121 | 0.19 | 0.32 | 0.015 | 0.001 | 5.67 | 11.9 | 1.96 | 0.041 | 0.040 |
| E | 0.0132 | 0.21 | 0.15 | 0.014 | 0.001 | 4.61 | 12.2 | 1.85 | 0.039 | 0.023 |
| F | 0.0102 | 0.17 | 0.24 | 0.014 | 0.001 | 6.21 | 11.9 | 2.68 | 0.040 | 0.024 |
| G | 0.0136 | 0.20 | 0.18 | 0.015 | 0.001 | 7.24 | 13.1 | 2.34 | 0.038 | 0.038 |
| H | 0.0112 | 0.19 | 0.27 | 0.014 | 0.001 | 6.35 | 12.2 | 2.04 | 0.039 | 0.037 |
| I | 0.0126 | 0.20 | 0.07 | 0.014 | 0.001 | 5.16 | 11.8 | 1.62 | 0.038 | 0.013 |
| J | 0.0105 | 0.19 | 0.48 | 0.015 | 0.001 | 6.96 | 12.7 | 2.34 | 0.039 | 0.048 |
| K | 0.0094 | 0.20 | 0.36 | 0.015 | 0.001 | 5.12 | 11.8 | 1.74 | 0.040 | 0.015 |
| L | 0.0106 | 0.17 | 0.52 | 0.015 | 0.001 | 6.75 | 13.2 | 2.54 | 0.041 | 0.022 |
| M | 0.0128 | 0.18 | 0.11 | 0.014 | 0.001 | 4.52 | 12.9 | 1.26 | 0.039 | 0.036 |
| N | 0.0138 | 0.20 | 0.41 | 0.014 | 0.001 | 6.12 | 12.9 | 1.75 | 0.041 | 0.033 |
| O | 0.0118 | 0.18 | 0.20 | 0.013 | 0.001 | 5.72 | 11.7 | 1.80 | 0.042 | 0.028 |
| P | 0.0109 | 0.21 | 0.33 | 0.014 | 0.001 | 6.12 | 12.4 | 2.44 | 0.039 | 0.015 |
| Q | 0.0116 | 0.20 | 0.10 | 0.015 | 0.001 | 7.86 | 13.5 | 2.63 | 0.040 | 0.014 |
| R | 0.0112 | 0.19 | 0.48 | 0.015 | 0.001 | 4.87 | 11.1 | 1.36 | 0.040 | 0.045 |
| S | 0.0100 | 0.19 | 0.45 | 0.014 | 0.001 | 7.34 | 13.9 | 2.68 | 0.039 | 0.015 |
| T | 0.0952 | 0.21 | 0.06 | 0.013 | 0.001 | 4.65 | 10.0 | 1.02 | 0.041 | 0.042 |

| Steel | Composition (mass %) | | | | | Ca, REM, | Value of formula (1) | Value of formula (2) | |
|---|---|---|---|---|---|---|---|---|---|
| No. | N | Ti | Cu | Co | Nb, W | Mg, B | (*1) | (*2) | Remarks |
| A | 0.0072 | 0.035 | 0.04 | 0.07 | — | — | −0.427 | −0.123 | Example |
| B | 0.0058 | 0.040 | 0.18 | 0.22 | — | — | −0.469 | −0.138 | Example |
| C | 0.0074 | 0.025 | 0.34 | 0.35 | — | — | −0.433 | −0.098 | Example |
| D | 0.0052 | 0.019 | 0.15 | 0.15 | Nb: 0.04 | — | −0.452 | −0.119 | Example |
| E | 0.0081 | 0.036 | 0.30 | 0.26 | W: 0.31 | — | −0.452 | −0.130 | Example |
| F | 0.0135 | 0.040 | 0.56 | 0.08 | — | Ca: 0.003 | −0.348 | −0.080 | Example |
| G | 0.0049 | 0.052 | 0.48 | 0.46 | — | Ca: 0.002, REM: 0.002 | −0.266 | −0.067 | Example |
| H | 0.0064 | 0.011 | 0.34 | 0.32 | — | Mg: 0.003 | −0.412 | −0.087 | Example |
| I | 0.0071 | 0.034 | 0.41 | 0.40 | — | B: 0.002 | −0.509 | −0.131 | Example |
| J | 0.0083 | 0.028 | 0.21 | 0.21 | Nb: 0.02 | Ca: 0.002 | −0.324 | −0.073 | Example |
| K | 0.0111 | 0.048 | 0.31 | 0.29 | — | — | −0.504 | −0.127 | Comparative Example |
| L | 0.0136 | 0.034 | 0.44 | 0.15 | — | — | −0.260 | −0.039 | Comparative Example |
| M | 0.0074 | 0.026 | 0.55 | 0.45 | — | — | −0.473 | −0.095 | Comparative Example |
| N | 0.0099 | 0.061 | 0.46 | 0.45 | — | — | −0.395 | −0.088 | Comparative Example |
| O | 0.0106 | 0.044 | 1.08 | 0.51 | Nb: 0.04 | — | −0.496 | −0.066 | Comparative Example |
| P | 0.0135 | 0.031 | 0.69 | 1.09 | — | — | −0.345 | −0.052 | Comparative Example |
| Q | 0.0065 | 0.050 | 0.96 | 0.41 | — | — | −0.184 | −0.005 | Comparative Example |
| R | 0.0118 | 0.017 | 0.03 | 0.05 | Nb: 0.04, W: 0.88 | — | −0.657 | −0.173 | Comparative Example |
| S | 0.0046 | 0.014 | 1.65 | 0.42 | — | — | −0.157 | 0.106 | Comparative Example |
| T | 0.0964 | 0.051 | 0.01 | 0.03 | W: 0.98 | — | −0.959 | −0.405 | Comparative Example |

* Underline means outside the range of the disclosed embodiments

·The balance is Fe and incidental impurities (*1) Formula (1): −0.0278 Mn + 0.0892 Cr + 0.00567 Ni + 0.153 Mo − 0.0219 W − 1.984 N + 0.208 Ti − 1.83

(*2) Formula (2): −1.324 C + 0.0533 Mn + 0.0268 Cr + 0.0893 Cu + 0.00526 Ni + 0.0222 Mo − 0.0132 W − 0.473 N − 0.5 Ti − 0.514

TABLE 2

| Steel pipe No. | Steel No. | Quenching: $Ac_3$ point (° C.) | Quenching: Heating temp. (° C.) | Quenching: Holding time (min) | Quenching: Cooling method | Quenching: Cooling stop temp. (° C.) | Tempering: $Ac_1$ point (° C.) | Tempering: Heating temp. (° C.) | Tempering: Holding time (min) | Microstructure: Retained γ (*1) (volume %) | Tensile properties: Yield stress YS (MPa) | Tensile properties: Tensile strength TS (MPa) | SSC resistance test: Presence or absence of cracking | Remarks |
|---|---|---|---|---|---|---|---|---|---|---|---|---|---|---|
| 1 | A | 760 | 920 | 20 | Air cooling | 25 | 645 | 600 | 60 | 5.0 | 826 | 865 | Absent | Example |
| 2 | B | 760 | 900 | 20 | Water cooling | 25 | 650 | 600 | 60 | 1.0 | 828 | 868 | Absent | Example |
| 3 | C | 760 | 920 | 20 | Air cooling | 25 | 640 | 590 | 60 | 4.9 | 843 | 885 | Absent | Example |
| 4 | D | 760 | 810 | 20 | Air cooling | 25 | 645 | 595 | 60 | 2.5 | 809 | 861 | Absent | Example |
| 5 | E | 760 | 810 | 20 | Air cooling | 25 | 650 | 585 | 60 | 0.0 | 792 | 837 | Absent | Example |
| 6 | F | 760 | 900 | 20 | Water cooling | 25 | 655 | 600 | 60 | 1.8 | 833 | 892 | Absent | Example |
| 7 | G | 760 | 920 | 20 | Water cooling | 25 | 635 | 590 | 60 | 23.4 | 874 | 922 | Absent | Example |
| 8 | H | 755 | 850 | 20 | Water cooling | 25 | 635 | 585 | 60 | 12.1 | 851 | 896 | Absent | Example |
| 9 | I | 760 | 900 | 20 | Air cooling | 25 | 655 | 580 | 60 | 0.4 | 811 | 867 | Absent | Example |
| 10 | J | 760 | 920 | 20 | Water cooling | 25 | 645 | 595 | 60 | 19.3 | 864 | 912 | Absent | Example |
| 11 | A | 760 | 710 | 20 | Water cooling | 25 | 645 | 595 | 60 | 14.1 | 714 | 775 | Absent | Comparative Example |
| 12 | B | 760 | 900 | 20 | Air cooling | 25 | 650 | 680 | 60 | 19.6 | 694 | 746 | Absent | Comparative Example |
| 13 | K | 760 | 920 | 20 | Air cooling | 25 | 640 | 595 | 60 | 1.1 | 801 | 851 | Present | Comparative Example |
| 14 | L | 760 | 810 | 20 | Air cooling | 25 | 655 | 600 | 60 | 18.4 | 857 | 894 | Present | Comparative Example |
| 15 | M | 760 | 810 | 20 | Water cooling | 25 | 650 | 600 | 60 | 5.5 | 785 | 836 | Present | Comparative Example |
| 16 | N | 760 | 900 | 20 | Air cooling | 25 | 645 | 600 | 60 | 19.9 | 834 | 889 | Present | Comparative Example |
| 17 | O | 755 | 810 | 20 | Water cooling | 25 | 630 | 590 | 60 | 9.9 | 843 | 884 | Present | Comparative Example |
| 18 | P | 755 | 920 | 20 | Air cooling | 25 | 640 | 585 | 60 | 9.4 | 868 | 917 | Present | Comparative Example |
| 19 | Q | 760 | 810 | 20 | Air cooling | 25 | 645 | 595 | 60 | 28.4 | 894 | 934 | Present | Comparative Example |
| 20 | R | 755 | 920 | 20 | Water cooling | 25 | 640 | 600 | 60 | 0.0 | 797 | 848 | Present | Comparative Example |
| 21 | S | 760 | 920 | 20 | Air cooling | 25 | 655 | 600 | 60 | 31.9 | 864 | 914 | Present | Comparative Example |
| 22 | T | 755 | 900 | 20 | Water cooling | 25 | 645 | 600 | 60 | 0.0 | 802 | 849 | Present | Comparative Example |

(*1) Retained γ: Retained austenite

* Underline means outside the range of the disclosed embodiments

The steel pipes of the Examples all had high strength with a yield stress of 758 MPa or more, demonstrating that the steel pipes were martensitic stainless steel seamless pipes having excellent SSC resistance that do not crack even when placed under a stress in a $H_2S$-containing environment. On the other hand, in Comparative Examples outside the range of the disclosed embodiments, the steel pipes did not have the desired high strength or desirable SSC resistance.

The invention claimed is:

1. A martensitic stainless steel seamless pipe for oil country tubular goods having a chemical composition comprising, by mass %:

C: 0.010% or more;
Si: 0.5% or less;
Mn: 0.05 to 0.50%;
P: 0.030% or less;
S: 0.005% or less;
Ni: 4.6 to 8.0%;
Cr: 10.0 to 14.0%;
Mo: 1.0 to 2.7%;
Al: 0.1% or less;
V: 0.005 to 0.2%;
N: 0.1% or less;
Ti: 0.010 to 0.054%;
Cu: 0.01 to 1.0%;
Co: 0.01 to 1.0%; and
the balance being Fe and incidental impurities,
wherein the following formulae (1) and (2) satisfy formula (3) below:

$$-0.0278Mn+0.0892Cr+0.00567Ni+0.153Mo-0.0219W-1.984N+0.208Ti-1.83 \quad (1)$$

$$-1.324C+0.0533Mn+0.0268Cr+0.0893Cu+0.00526Ni+0.0222Mo-0.0132W-0.473N-0.5Ti-0.514 \quad (2)$$

where C, Mn, Cr, Cu, Ni, Mo, W, N, and Ti represent the content of each element by mass %, and the content is 0% for elements that are not contained, $-0.600 \leq$ formula (1) $\leq -0.412$, and $-0.400 \leq$ formula (2) $\leq 0.100$ (3), the martensitic stainless steel seamless pipe has a yield stress of 758 MPa or more, and no crack is observed in a sample piece of the martensitic stainless steel seamless pipe subjected to a test environment created by adjusting a pH of a 20 wt % NaCl aqueous test solution having a liquid temperature of 25° C. 0.1 bar $H_2S$, and a balance of $CO_2$, to 4.0 with addition of 0.82 g/L of sodium acetate and acetic acid, and a stress 90% of the yield stress being applied for 720 hours in the test solution.

2. The martensitic stainless steel seamless pipe for oil country tubular goods according to claim 1, wherein the chemical composition further comprises, by mass %, at least one selected from the group consisting of Nb: 0.1% or less, and W: 1.0% or less.

3. The martensitic stainless steel seamless pipe for oil country tubular goods according to claim 2, wherein the chemical composition further comprises, by mass %, at least one selected from the group consisting of Ca: 0.010% or less, REM: 0.010% or less, Mg: 0.010% or less, and B: 0.010% or less.

4. The martensitic stainless steel seamless pipe for oil country tubular goods according to claim 1, wherein the chemical composition further comprises, by mass %, at least one selected from the group consisting of Ca: 0.010% or less, REM: 0.010% or less, Mg: 0.010% or less, and B: 0.010% or less.

5. The martensitic stainless steel seamless pipe for oil country tubular goods according to claim 1, wherein $-0.600 \leq$ formula (1) $\leq -0.427$.

6. The martensitic stainless steel seamless pipe for oil country tubular goods according to claim 1, wherein $-0.600 \leq$ formula (1) $\leq -0.427$ and $-0.400 \leq$ formula (2) $\leq -0.130$.

7. A method for manufacturing a martensitic stainless steel seamless pipe for oil country tubular goods according to claim 1, the method comprising:

forming a steel pipe from a steel pipe material having the chemical composition;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

8. A method for manufacturing a martensitic stainless steel seamless pipe for oil country tubular goods according to claim 2, the method comprising:

forming a steel pipe from a steel pipe material having the chemical composition;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

9. A method for manufacturing a martensitic stainless steel seamless pipe for oil country tubular goods according to claim 4, the method comprising:

forming a steel pipe from a steel pipe material having the chemical composition;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

10. A method for manufacturing a martensitic stainless steel seamless pipe for oil country tubular goods according to claim 3, the method comprising:

forming a steel pipe from a steel pipe material having the chemical composition;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

* * * * *